United States Patent [19]

Tureaud

[11] Patent Number: 4,496,151

[45] Date of Patent: Jan. 29, 1985

[54] BOWLING AID DEVICE

[76] Inventor: Aloysius K. Tureaud, 213 E. Washington St., Ann Arbor, Mich. 48104

[21] Appl. No.: 440,781

[22] Filed: Nov. 10, 1982

Related U.S. Application Data

[63] Continuation-in-part of Ser. No. 302,924, Sep. 16, 1981, abandoned.

[51] Int. Cl.[3] ..... A63B 69/00

[52] U.S. Cl. ..... 273/54 B

[58] Field of Search ..... 273/54 B, 75, 165, 166; 2/161 A; 46/25; 294/25

[56] References Cited

U.S. PATENT DOCUMENTS

| | | | |
|---|---|---|---|
| 300,360 | 6/1884 | Gray | 273/72 R |
| 1,581,647 | 2/1926 | Layton | 273/72 R UX |
| 2,738,190 | 3/1956 | Tureaud | 273/54 B |
| 3,031,680 | 5/1962 | Compiano | 273/54 B X |
| 3,123,832 | 3/1964 | Kubik | 273/54 B X |
| 3,203,006 | 8/1965 | Shirley | 273/54 B X |
| 3,224,012 | 12/1965 | Hamm | 273/54 B X |
| 3,262,702 | 7/1966 | Kovacs | 273/54 B |
| 3,344,436 | 10/1967 | Stubbs | 273/54 B X |
| 3,398,951 | 8/1968 | Disko | 273/54 B |
| 3,413,000 | 11/1968 | Alkonis | 273/54 B |
| 3,421,160 | 1/1969 | Domenico | 273/54 B |
| 3,438,630 | 4/1969 | Petti | 273/54 B |
| 3,496,573 | 2/1970 | Kuchas et al. | 273/54 B X |
| 3,501,773 | 3/1970 | Stansberry et al. | 273/54 B X |
| 3,564,613 | 2/1971 | Fowler | 273/54 B X |
| 3,583,704 | 6/1971 | Callanan | 273/54 B |
| 3,598,408 | 8/1971 | Klone | 273/54 B |
| 3,606,319 | 9/1971 | Borden | 273/54 B |
| 3,606,614 | 9/1971 | Dimitroff | 2/159 |
| 3,672,673 | 6/1972 | Hicks | 273/54 B |
| 3,728,738 | 4/1973 | Andolino | 273/54 B X |
| 3,772,706 | 11/1973 | Brigidi | 273/54 B X |
| 3,790,168 | 2/1974 | Hashimoto | 273/54 B |
| 4,143,496 | 3/1979 | Destito | 273/293 X |
| 4,284,275 | 8/1981 | Fletcher | 273/75 |

FOREIGN PATENT DOCUMENTS

| | | | |
|---|---|---|---|
| 870810 | 6/1961 | United Kingdom | 46/25 |

*Primary Examiner*—Anton O. Oechsle
*Attorney, Agent, or Firm*—Krass & Young

[57] ABSTRACT

A bowling aid device adapted to be carried in the palm of a bowler's hand maintains a preselected spacing between the palm and the ball so as to consistently control the penetration depth of the bowler's fingers into the ball. The device includes a palm pad of generally resilient material having open cells in one face thereof to produce suction action gripping with the palm. Alternatively, a layer of adhesive material over the palm engaging face is employed to prevent relative movement between the pad and the palm. Any of a plurality of differently configured inserts may be attached to the palm side of the pad in order to incline the ball engaging face of the pad at differing angles relative to the ball. The ball engaging face of the pad may include a friction producing substance such as silica to prevent slippage between the ball and the pad. The spacing between the bowler's palm and the ball may be conveniently altered in order to adapt the device to various hand sizes.

10 Claims, 15 Drawing Figures

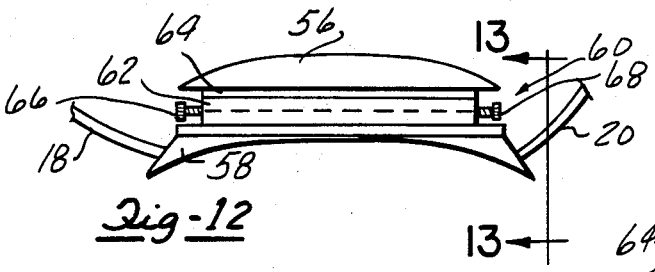
Fig-12
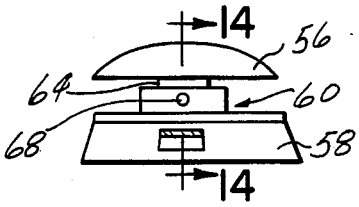
Fig-13
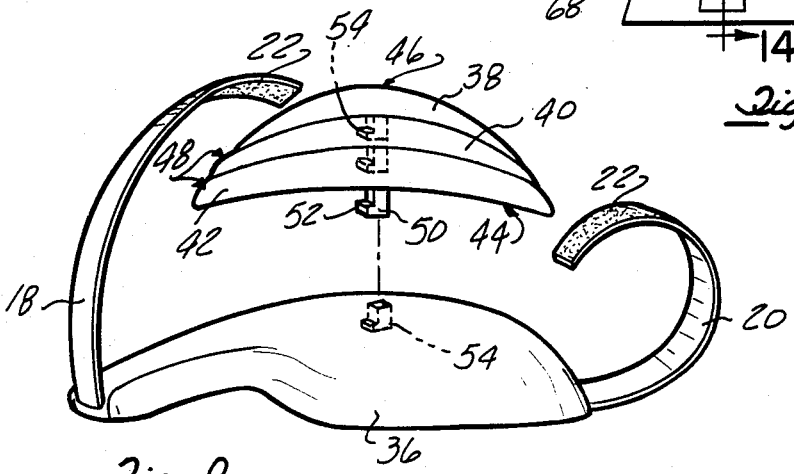
Fig-9
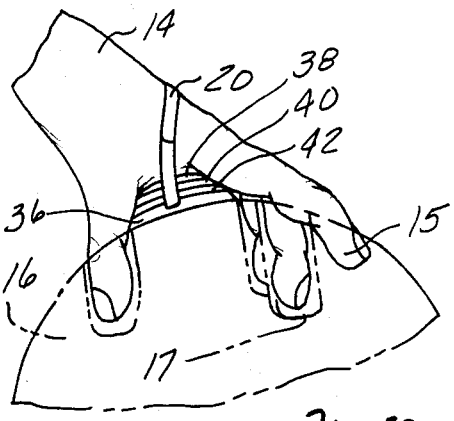
Fig-10
Fig-11
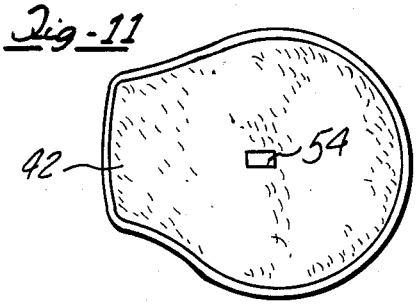
Fig-14
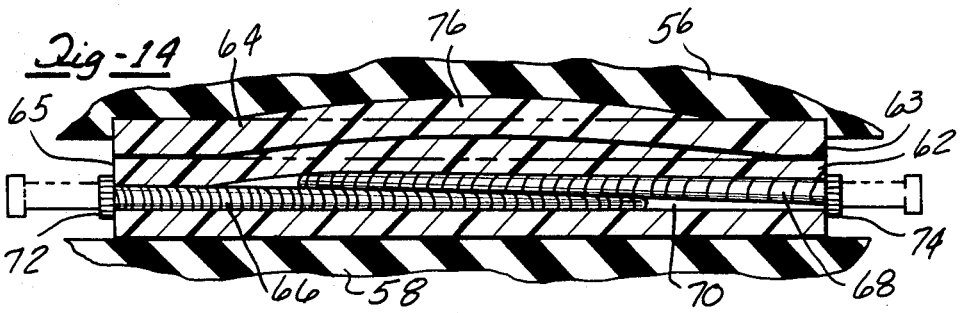

BOWLING AID DEVICE

CROSS REFERENCE TO RELATED APPLICATIONS

This application is a continuation-in-part of U.S. Ser. No. 302,924, filed Sept. 16, 1981, abandoned.

TECHNICAL FIELD

The present invention broadly relates to the game of bowling, and deals more particularly with a hand worn aid for maintaining a bowling ball in a desired position relative to the hand.

BACKGROUND ART

Hand worn bowling aids are well known in the art. These aids are employed to maintain the hand or the fingers in a certain position relative to a bowling ball so as to enable the bowler to release the ball during delivery in a consistent manner.

A typical device of the type referred to above is disclosed in U.S. Pat. No. 2,738,190. This prior art device consists of a pad adapted to lie in the palm of the bowler's hand and includes a cup-shaped surface which conformingly engages the ball. A strap secured to the pad surrounds the bowler's hand in order to maintain the pad in place. Although this device is suitable for its intended purpose, it is subject to improvement in several respects. For example, perspiration on the bowler's hand substantially reduces friction between the pad and the palm; this results in slippage between the pad and the palm during release of the ball. Such relative movement between the palm and the pad can affect ball release and is therefore undesirable.

A similar problem of slippage exists between the ball and the ball engaging surface of the pad. This reduces the amount of spin that the bowler can impart the ball and thus limits the bowler's ability to adjust to various lane conditions.

Known prior art devices include means for producing a predefined amount of spacing between the bowler's palm and the ball due to the fact that such spacing affects the control and delivery of the ball. The amount of spacing which is optimal varies according to the size of the bowler's hand, and to some extent, the style of his or her ball delivery. However, none of the prior art devices provide a convenient and simple means of adjusting the spacing so as to achieve optimal results.

DISCLOSURE OF THE INVENTION

It is therefore an important object of the present invention to overcome each of the dificiencies discussed above and, consequently, the present invention represents an improvement of the device disclosed in U.S. Pat. No. 2,738,190. The bowling aid device of the present invention is adapted to be carried in the palm of the bowler's hand in order to maintain a preselected spacing between the palm and the ball so as to consistently control the penetration depth of the bowler's fingers into the ball. The device includes a palm-pad of generally resilient material having open cells in one face thereof which produce suction action gripping between the palm and the pad. Alternatively, a layer of adhesive material over the palm face of the pad is employed to prevent relative movement between the pad and the palm during delivery of the ball. Any of a plurality of differently configured inserts may be attached to the palm side of the pad in order to incline the ball engaging face of the pad at differing angles relative to the ball. The ball engaging pad face may include a friction producing substance such as silica to prevent slippage between the ball and the pad. Additionally, means are provided to alter the spacing between the bowler's palm and the ball.

BRIEF DESCRIPTION OF THE DRAWINGS

In the drawings, which form an integral part of the specification and are to be read in conjunction therewith, and in which like reference numerals are employed to designate identical components in the various views:

FIG. 9 is a perspective view of an alternate form of the device of the present invention, the outer layers of the pad having been removed for clarity;

FIG. 10 is an elevational view of the device shown in FIG. 9, shown in operative relationship between a bowling ball and the hand of a bowler;

FIG. 11 is a top plan view of one of the layers of the device shown in FIG. 9;

FIG. 12 is a side elevational view of another alternate form of the device of the present invention;

FIG. 13 is a sectional view taken along the line 13—13 in FIG. 12; and, FIG. 14 is a sectional view taken along the line 14—14 in FIG. 13.

BEST MODE FOR CARRYING OUT THE INVENTION

Figure 1:
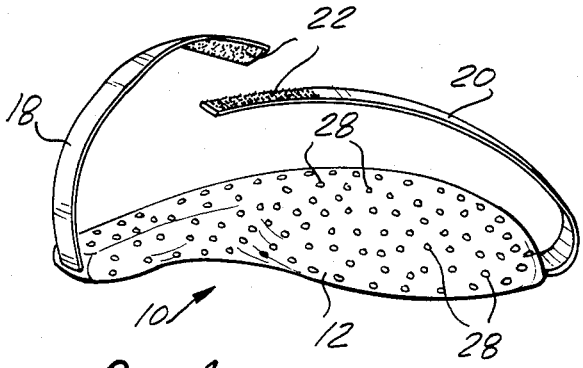
FIG. 1 is a perspective view of the bowling aid device which forms the preferred embodiment of the present invention.
Figure 2:
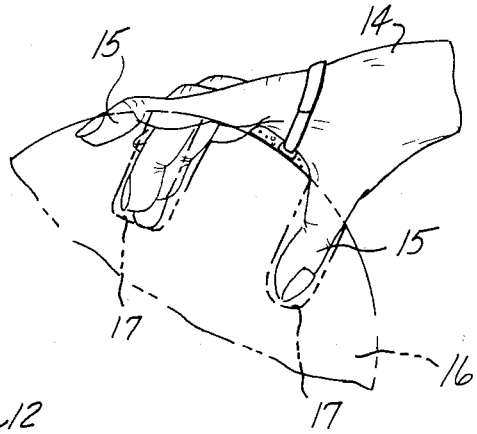
FIG. 2 is an elevational view of the device shown in FIG. 1 installed on a bowler's hand in operative relationship to a bowling ball.
Figure 3:
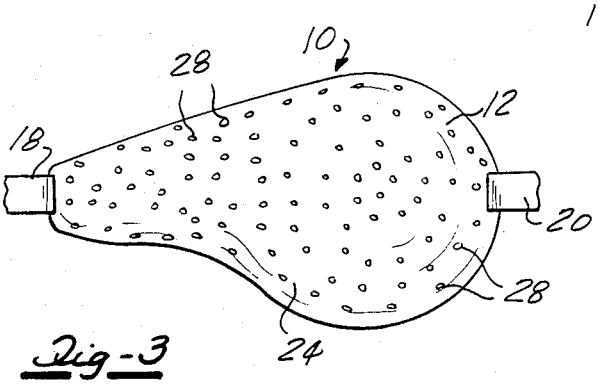
FIG. 3 is a top plan view of the device shown in FIG. 1.

Referring first to FIGS. 1–3, 5*a* and 5*b*, the present invention is generally concerned with a bowling aid device, broadly indicated by the numeral 10, which includes a kidney-shaped pad 12 adapted to be installed in the abutting contact in the palm of a bowler's hand 14. The pad 12 is therefore interposed between the palm of the hand 14 and the curved surface of the bowling ball 16, as best seen in FIG. 2.

The pad 12 functions to maintain a preselected spacing between the bowler's palm and the ball, which in turn limits the depth of penetration of the bowler's fingers 15 into the ball holes 17. In this manner, the bowler's fingernails do not come into contact with the bottom of the ball holes, and the knuckles of the fingers are maintained at a desired attitude relative to the edges of the ball holes 17.

The aid 10 further includes a strap comprising first and second sections 18 and 20 respectively secured on opposite extremities of a pad 12, which are adapted to encircle the bowler's hand 14 to maintain the pad 12 in proper position in the palm. Velcro attached to the ends of the strap sections 18 and 20 permits rapid attachment and release of the aid 10 on the bowler's hand 14.

Figure 5B:
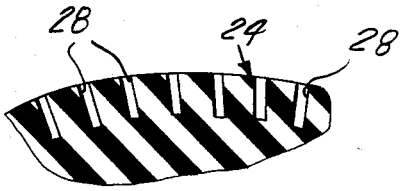
FIGS. 5*a* and 5*b* are fragmentary, cross-sectional views of the palm engaging face of the device shown in FIGS. 1–3.
Figure 5A:
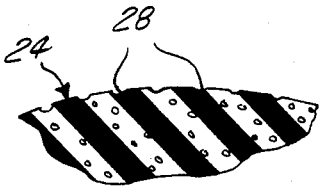

The pad 12 is formed of generally resilient material such as rubber or plastic and is provided with a plurality of apertures 28 in the face 24 thereof which engages the bowler's palm. As shown in FIG. 5*a*, the apertures 28 may be defined by a cellular structure inherent in the material comprising the pad 12. Such cells may be produced by employing a cellular type foam, with the face 24 being sheared so as to expose the cells near the surface. Alternatively, as shown in FIGS. 5*b*, the apertures 28 may be machined or molded in the face 24, if desired. Apertures 28 function to create suction action gripping between the bowler's palm and the face 24 of pad 12 so as to prevent relative movement between pad 12 and the bowler's hand 14. The suction action of the apertures 28 is enhanced by normal perspiration on the bowler's hand.

Figure 4:
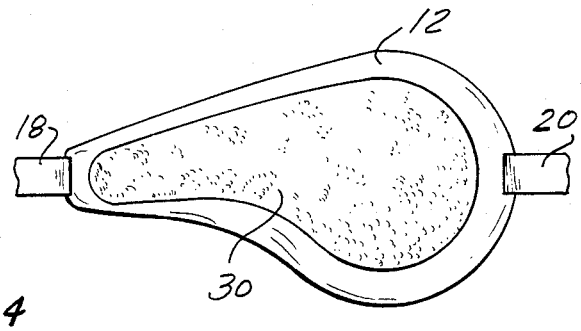
FIG. 4 is an alternate form of the device shown in FIGS. 1–3.

Referring now to FIG. 4, slippage between the pad 12 and the bowler's hand may be substantially eliminated by the application of an adhesive layer 30 on the palm face 24 of pad 12. Those skilled in the art will recognize that various adhesive coatings may be employed over the face 24 to produce the desired slip resistance.

Figure 6:
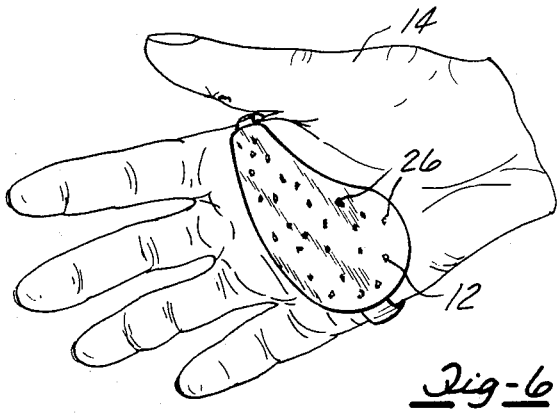
FIG. 6 is a perspective view of the device shown in FIGS. 1–4 shown installed on a bowler's hand.

As best seen in FIG. 6, the ball engaging face 26 is slightly concaved in shape in order to conformly engage the contour of the ball. The ball engaging face 26 may also include a layer of coating of non-slip material thereon, such as a silica distributed over face 26, in order to increase friction between the ball and the pad 12; in this manner the bowler may impart substantially more "spin" on the ball.

Figure 7:
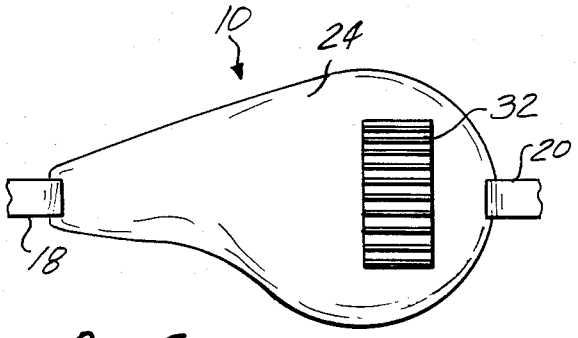
FIG. 7 is a plan view of the palm engaging face of the device shown in FIGS. 1–4 having an optional insert installed thereon.
Figure 8:
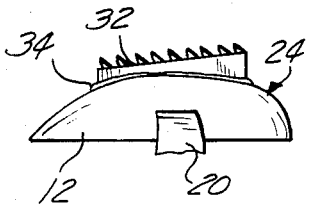
FIG. 8 is an end view of the device shown in FIG. 7.

Referring also now to FIGS. 7 and 8, the inclination of the ball 16 relative to the bowler's palm may be conveniently altered by installing a wedge-shaped insert 32 on the palm face 24 of pad 12. The insert 32 may taper at various angles, according to the degree of ball inclination that is desired, and is removably attached to face 24 by means of an adhesive strip 34 applied to face 24 of pad 12. The bowler may readily remove and replace the insert 32 to incline the pad 12 relative to his palm in order to adapt to various lane conditions.

The combination of the adhesion between the bowler's palm and the pad 12, the position of the bowler's fingers relative to the ball holes 17 and the increased friction achieved between the ball and the pad 12 allows the bowler to impart substantially more lift to the ball 16 and improves ball control as well.

Attention is now directed to FIGS. 9–11 wherein an alternate form of the bowling aid device is depicted. A substantially kidney-shaped palm member 36 includes a concave surface similar to that described previously which is adapted to conformingly engage the the ball 16. Palm member 36 may be formed of resilient, deformable rubber or plastic material, similar to the device 10 previously described and includes a pair of straps 18 and 20 preferably molded integral therewith which are adapted to secure the device to a bowler's hand by means of velcro strips 22.

The device further includes a plurality of layers 38–42 which are interconnected with each other and provide a means for adjusting the spacing between the bowler's palm and the ball 16, as will be later described. Each of the layers 38–42 include a first concave surface as at 44 and a second convex surface 46. Layers 40 and 42 are interposed between layer 38 and palm member 36, with the concave surface 44 of layer 42 conformingly engaging the upper surface of palm member 36, and the upper convex surface of layer 40 conformingly engaging the concave surface of upper layer 38. The upper convex surface 46 of layer 38 is adapted to conformingly engage the bowler's palm. As best seen in FIGS. 9 and 10 the outer edge of layer 40 extends outwardly of the outer edge of layer 38 and the outer edge of layer 42 extends outwardly of the outer edge of layer 40 as the layers progress toward the palm member 36 such that the outer edges 48 form a continuation of convex surface 46 and are likewise adapted to engage the bowler's palm.

The upper layer 38 is provided with a centrally located, downwardly depending projection 50 having a locking tab 52 on one extremity thereof. The projection 50 is received within an aperture 54 in layer 40, the aperture 54 being configured to matingly receive the projection 50 and locking tab 52 of layer 38. Layers 40 and 42 are likewise provided with projections 50 and locking tabs 52, tabs 52 being adapted to be releasably received in locking relationship within corresponding apertures 54 in the concave surface of layer 42 and palm member 36.

Each of the layers 38–42 are formed of resilient, deformable material, similar to the material of palm member 36 and may be manufactured as by molding or the like.

In use, the projections of 54 of each layer 38–42 are inserted into the corresponding aperture 54, thereby locking the layers 38–42 into stacked, abutting relationship to each other on palm member 36. In order to alter the spacing between the bowler's palm and the ball 16, the user need only remove or add one or more of the layers 38–42 thereby altering the overall thickness of the device.

Reference is now made to FIGS. 12–14 where still another alternate form of the bowling aid device is depicted. The device includes a first section 56 adapted to conformingly engage a bowler's palm, and a second section 58 adapted to conformingly engage a bowling ball. Straps 18 and 20 secured to the second section 58 secure the device on the bowler's hand 14. Means generally indicated at 60 are provided for altering the overall thickness of the device, and thus of the spacing between the bowler's palm and the ball 16. The space altering means 60 includes a substantially rectangularly shaped member 62 formed of deformable, resilient material such as rubber or the like. The bottom face of member 62 is secured as by bonding to an upper planar face of second section 58. The upper face of member 62 is secured as by bonding to a rectangular mounting member 64 which is in turn secured to the lower face of first section 56.

Member 62 is provided with an aperture 70 extending laterally therethrough which terminates in openings in opposite lateral faces 63 and 65 of member 62. Means for compressing the opposite lateral sides of member 62 in the nature of a pair of tapered screws 66 and 68 extend through faces 63 and 65 into the aperture 70. Screws 66 and 70 each possess a minor diameter which increases from the free extremity thereof toward the corresponding head 72,74. Screws 66 and 68 threadably engage each other within aperture 70 and the associated heads 72,74 bear against the corresponding faces 65,63.

Turning the screws 72,74 in one direction draws such screws toward each other thereby applying laterally inwardly directed forces on the faces 63 and 65; this inwardly directed compressive force results in the outward deformation of a portion of the member, as at 76 in a direction extending between the bowler's palm and the ball 16. This deformation or extension effectively increases the spacing between the first and second sections 56 and 58. Loosening of screws 66 and 70 releases the lateral compressive force on member 62, and by virtue of the resilient nature of the member 62, the deformation as at 76 is eased and the spacing between sections 56 and 58 is decreased.

It may be appreciated that depending upon the construction and selection of materials for member 62, as well as the placement of aperture 70, either the portion above or below the aperture 70 may be deformed. As previously indicated, the first and second sections 56 and 58 respectively are each formed of deformable, resilient material so that some deformation of either or both of these sections may result from the pressure applied thereto by the deformation force imposed thereon by member 62.

From the foregoing, it can be appreciated that the bowling aid device described above not only provides for the reliable accomplishment of the objects of the invention but does so in a particulary effective and reliable manner. It is recognized, of course, that those skilled in the art may make various modifications or additions to the preferred embodiment of the present invention without departing from the spirit and scope of the present contribution of the art. For example, the suction action created between the pad 12 and the bowler's palm might be created by various forms of suction cups or other devices interposed between the pad 12 and the bowler's palm. Also, the member 62 may be formed of two descrete wedge shaped sections which possess inclined abutting surfaces which result in an alteration of the spacing between the bowler's palm and the ball upon the application of lateral pressure to the member 62. Accordingly, it is to be understood that the protection sought and to be afforded hereby should be deemed to extend to the subject matter claimed and all the equivalents thereof early within the scope of the invention.

I claim:

1. A bowling aid device, comprising:

a palm member for maintaining a preselected spacing between the palm of a bowler's hand and a bowling ball gripped by the bowler, said palm member having a first face adapted to engage said palm and having a second face adapted to conformingly engage said bowling ball, said palm member including a plurality of discrete layers interposed between said first and second faces and means for releasably securing said layers between said first and second faces, at least portions of the outer edges of said layers defining sections of said first face of said palm member, whereby individual ones of said layers may be added or removed from said palm member and thereby alter the spacing between siad palm and said bowling ball.

2. The device of claim 1, including a pair of straps secured to opposite sides of said palm member and releasable holding means for releasably holding the adjacent extremities of said straps.

3. The device of claim 1, wherein the magnitudes of the peripheries of said layers are different from each other.

4. A bowling aid device for maintaining a preselected spacing between the palm of a bowler's hand and a bowling ball, comprising:

a first section adapted to engage said bowler's palm;

a second section adapted to engage said bowling ball; and means interposed between said first and second sections for altering the spacing between said first and second sections, including a member which is extensible in a direction extending between said first and second sections upon the application of compressive force on opposite lateral sides thereof, whereby extension of said member alters the spacing between said first and second sections, said altering means further including means for applying compressive force on said opposite lateral sides of said member.

5. The device of claim 4, wherein said member is formed of resilient deformable material.

6. The device of claim 5, wherein said force applying means includes an aperture extending laterally therethrough and a pair of screws within said aperture conjugally engaging each other, said screws being adapted to apply lateral compressive force on said member upon turning of said screws relative to each other.

7. The device of claim 6, wherein each of said screws include a head on one end thereof engaging a portion of said member, and the minor diameter of each of said screws increases from the other end thereof toward said head.

8. The device of claim 7, wherein said opposite lateral sides of said member respectively include a pair of faces adapted to engage said heads of said screws.

9. The device of claim 4, including a pair of straps secured to said second section and adapted to retain said device on said bowler's hand.

10. The device of claim 4, wherein at least one of said first and second sections consist of resilient deformable material yieldable to the extension of said member.

* * * * *